United States Patent [19]

Beaufort

[11] Patent Number: 4,494,376

[45] Date of Patent: Jan. 22, 1985

[54] FLUID ACTUATED JACK MECHANISM

[75] Inventor: Ronald E. Beaufort, Laguna Niguel, Calif.

[73] Assignee: Varco International, Inc., Orange, Calif.

[21] Appl. No.: 284,672

[22] Filed: Jul. 20, 1981

[51] Int. Cl.[3] ..... F15B 13/042; F15B 13/06; F16H 39/46; E21B 19/08

[52] U.S. Cl. ..... 60/421; 60/428; 60/429; 60/444; 60/461; 60/476; 60/484; 60/486; 166/77; 254/106

[58] Field of Search ..... 60/421, 428, 429, 443, 60/444, 433, 434, 461, 465, 466, 473, 475, 476, 484, 486; 91/6, 31; 166/77; 254/106

[56] References Cited

U.S. PATENT DOCUMENTS

| | | | |
|---|---|---|---|
| 2,309,983 | 2/1943 | Riddle | 60/421 X |
| 3,096,075 | 7/1963 | Brown | 254/106 X |
| 3,788,773 | 1/1974 | Van der Kolk | 60/444 X |
| 3,901,032 | 8/1975 | Steiger et al. | 60/466 X |
| 3,999,610 | 12/1976 | Sage et al. | 166/77 X |
| 4,359,130 | 11/1982 | Kirkham | 60/428 |

FOREIGN PATENT DOCUMENTS

| | | | |
|---|---|---|---|
| 214341 | 11/1956 | Australia | 60/486 |
| 1203263 | 7/1959 | France | 60/486 |
| 49-6708 | 1/1974 | Japan . | |

*Primary Examiner*—Irwin C. Cohen
*Attorney, Agent, or Firm*—William P. Green

[57] ABSTRACT

A jacking mechanism for jacking a well casing or other well pipe vertically, and including a hydraulic control system in which a reversible variable displacement pump acts in one condition to deliver pressure fluid in parallel with another pump to the lower end of a jacking cylinder to actuate the piston thereof upwardly, with fluid discharging from the upper end of the cylinder to the variable displacement pump and being metered therethrough to regulate the rate of upward movement of the piston. In a second condition of the apparatus, flow through the variable displacement pump is reversed to lower the piston, and a variable restriction valve regulates discharge of fluid from the lower end of the cylinder to act with the variable displacement pump in regulating downward movement of the piston and supported pipe. In a third condition of the apparatus, the variable displacement pump discharges fluid to the lower end of the cylinder in a relation exerting an upward force of increased power on the piston and suspended pipe.

17 Claims, 8 Drawing Figures

SLOW LIFT

LOWERING

FAST LIFT

FLUID ACTUATED JACK MECHANISM

BACKGROUND OF THE INVENTION

This invention relates to improved jacking mechanisms for suspending and moving vertically a well pipe or the like. The invention will be described primarily as utiliuzed for lowering a string of casing into a well. U.S. patent application Ser. No. 6/169,718 filed July 17, 1980 by Boyadjieff et al. on "Well Casing Jack Mechanism", and U.S. patent application Ser. No. 6/268,762 filed June 11, 1981 now abandoned by Boyadjieff et al. on "Well Pipe Jack", show devices which are adapted to be mounted in a well drilling rig and act to lower a string of casing or other pipe into the well when the weight of the string exceeds that for which the derrick and related equipment are designed. These devices include two cylinders located at opposite sides of the well string and having pistons which are actuable upwardly and downwardly by fluid pressure to relatively reciprocate two pipe gripping units in a manner progressively jacking the pipe string downwardly. Pressure fluid may be supplied to the cylinders from a power supply unit at a side of the well through flexible hoses leading to the cylinders, and under the control of an operator on the rig floor.

SUMMARY OF THE INVENTION

The present invention provides an improved fluid control system for a jacking mechanism of the above or any similar type, which system is in certain respects especially adapted for satisfying the requirements encountered in lowering a heavy string of casing or the like into a well. During the actual downward movement of a string of casing by such a jacking mechanism, the weight of the casing is supported by an upper one of the gripping units of the jack mechanism, and the actuating cylinder or cylinders must be capable of moving the upper gripping unit and pipe downwardly under that heavy load but with effective control and regulation of the rate and extent of such movement. After the upper gripping unit has been lowered through a complete stroke, the string is gripped and suspended by a second and lower gripping unit while the upper unit is released and returned upwardly for a next successive stroke. This upward returning movement is under relatively light load, and should be performed as rapidly as possible in order to minimize loss of time in the overall operation. At the top of the return stroke, the upper gripping unit again assumes the weight of the string and is actuated upwardly a short distance in order to release the gripping action of the lower unit. This slight upward movement of the upper gripping unit and string is under heavy load and requires exertion of a heavy upward force by the jack.

The jacking system embodying the invention provides for all of the above discussed different types of powered actuation in precisely controlled fashion while continually insuring effective support of the string. The jack can lower a pipe string at a substantial rate of speed, and can return the pistons upwardly at either of two different rates of speed, with a capability for exertion of greater upward force at the slower of these speeds than at the faster speed, to provide the increased force required for releasing the string from engagement with the lower gripping unit. These results are achieved in substantial part by the provision of variable displacement pump means acting in conjunction with additional pump means and a related conduit system and control means to actuate the pistons in different ways for accomplishing the desired functions. In one condition of the control means, the variable displacement pump means and the additional pump means discharge in parallel to the lower end of the cylinders, with fluid returning from the upper end of the cylinders to the variable displacement pump means in a manner enabling the variable displacment pump means to meter the return flow and thereby control the rate of upward movement of the pistons. In a second condition of the control apparatus, the variable displacement pump means are reversed to discharge fluid in the opposite direction into the upper ends of the cylinders, with fluid exhausting from the lower ends of the cylinders through variable restriction valve means adjustable to different conditions to control the rate of downward movement of the pistons and suspended pipe. In a third condition, the variable displacement pump means discharge into the lower ends of the cylinders, to move the pistons upwardly under increased force and at a reduced rate for releasing the lower gripping units as discussed.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIEMENTS

Figure 1:
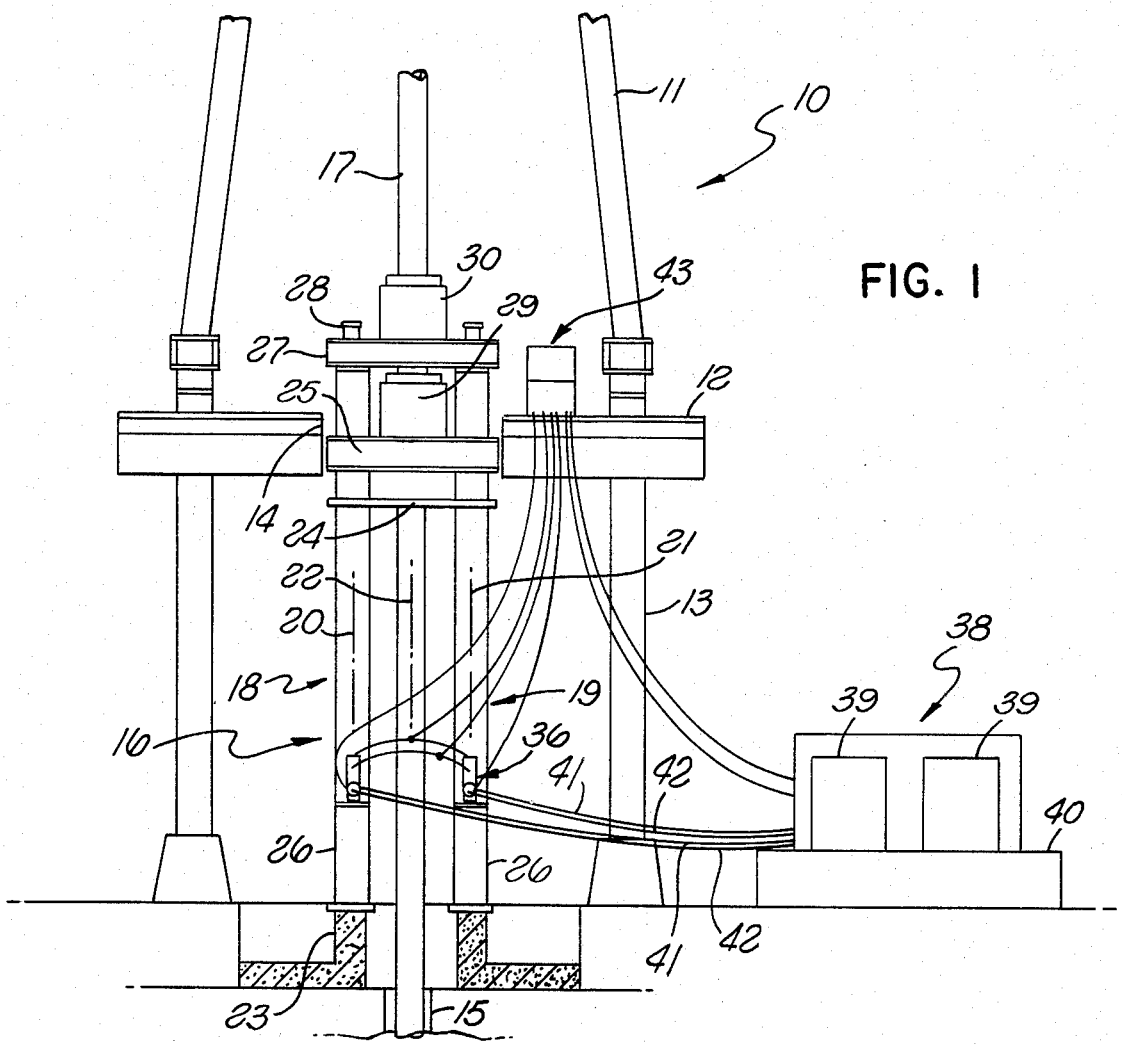
FIG. 1 shows a jack mechanism embodying the present invention positioned within a well drilling rig.

FIG. 1 represents fragmentarily at 10 a well drilling rig having a derrick 11 and a rig floor 12 supported on the ground by a substructure 13. The floor contains an opening 14 which during drilling of well 15 contains a rotary table for driving the drill string. After the well has been drilled, the rotary table may be removed from opening 14 and a jacking mechanism 16 embodying the present invention can then be positioned in the opening for lowering a string of casing 17 into the well. The jack mechanism 16 is perferably of the type disclosed in copending application Ser. No. 6/268,763 filed June 11, 1981 on "Well Pipe Jack"; and in particular includes two vertically extending piston and cylinder mechanisms 18 and 19, projecting upwardly along two parallel vertical axes 20 and 21 disposed parallel to and at diametrically opposite sides of the main vertical axis 22 of the well. The lower ends of piston and cylinder mechanisms 18 and 19 may be supported from the ground through a base 23 of cement or the like, with the upper ends of these mechanisms projecting upwardly into opening 14 in the rig floor and being retained against horizontal movement by extension through openings in a positioning template 24 appropriately secured to or fixed relative to the substructure of the rig. A beam 25 extends horizontally between and interconnects and is supported by the upper ends of the cylinders 26 of mechanisms 18 and 19, and contains an opening through which casing 17 extends. A second beam 27 similarly extends between and interconnects and is supported by and movable vertically with the upper ends of the piston rods 28 of piston and cylinder mechanisms 18 and 19, and contains an opening through which the casing extends. Two gripping units 29 and 30 are supported by the two beams or support structures 25 and 27 respectively, and are adapted to releasably grip and support the casing 17 or other well pipe. These gripping units are preferably of the well known slip type, having wedge slips which are power actuable under the control of an operator between casing gripping and released conditions.

Figure 3:
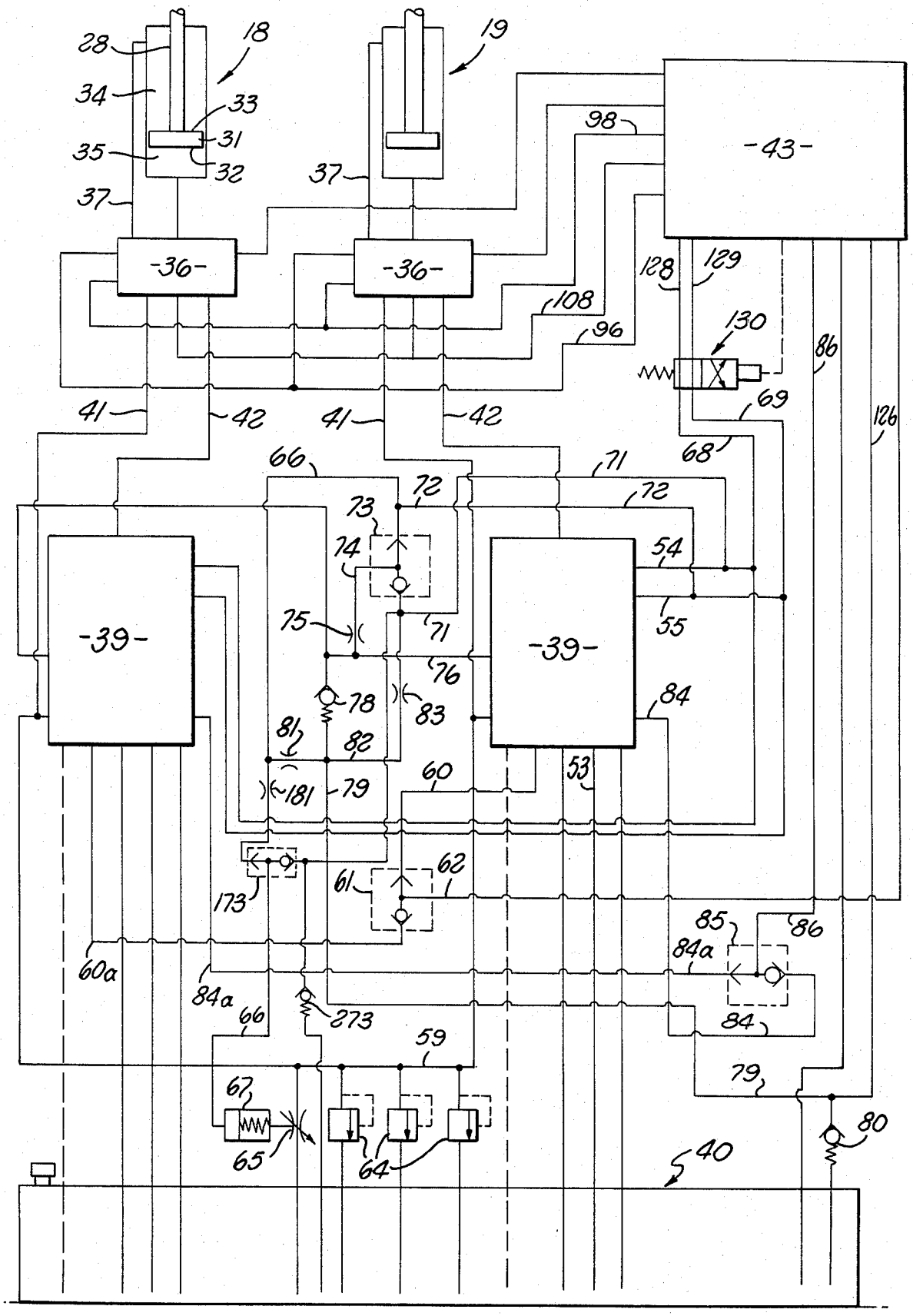
FIG. 3 is a general representation of the hydraulic control and actuating circuit of the jacking mechanism.

As seen best in FIG. 3, the pistons 31 of mechanisms 18 and 19 have undersurfaces 32 which are of greater effective area transversely of axes 20 and 21 than the upwardly facing upper surfaces 33 of the pistons exposed to pressure fluid, by reason of the fact that piston rods 28 are connected to the upper sides of the pistons and project upwardly therefrom and therefore occupy a substantial portion of the cross sectional area of the upper fluid chambers 34 above the pistons. More specifically, undersurfaces 32 of the pistons extend entirely across the cross sectional area of the cylinders and are exposed to pressure fluid in lower chambers 35 across that entire area, while upper annular surfaces 33 of the pistons about rods 28 are exposed to only the fluid within the annulae radially between the cylinders and piston rods. As a result, any given pressure of fluid within one of the lower chambers 35 can exert a total upward force on the associated piston greater than the downward force which would be exerted against the piston by the same pressure in upper chamber 34.

Figure 2:
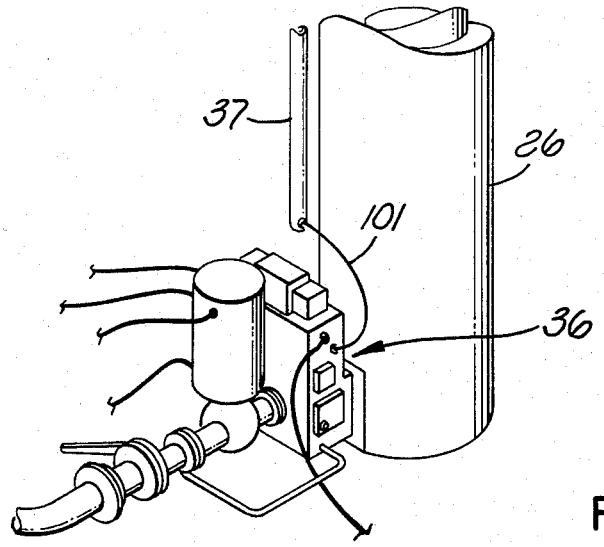
FIG. 2 is a perspective view of the valve assembly at the base of one of the two jacking cylinders of FIG. 1.

In accordance with the teachings of the present invention, the pressure fluid is supplied to and discharged from cylinders 26 through two valve and manifold assemblies 36 which are located adjacent and secured to the lower ends of the two cylinders 26 respectively (see FIGS. 1 and 2). Tubes 37 extending upwardly along the sides of the cylinders deliver fluid between assemblies 36 and the upper cylinder chambers 34 above the pistons. A pumping assembly 38 may be located on the ground at a side of the well, and may be considered as consisting primarily of two pressurized fluid sources 39 associated with the two piston and cylinder mechanisms 18 and 19 respectively. A supply of hydraulic fluid is contained within reservoir 40 from which units 39 take suction. The hydraulic fluid flows between each of the units 39 and the associated valve assembly 36 through a first hose 41 which is of relatively large diameter (say four inch internal diameter) and a second hose 42 of smaller diameter (say two inches internal diameter). Hoses 41 though capable of handling a greater rate of flow than hoses 42, cannot withstand as great a pressure as hoses 42, and in the hydraulic circuitry of the present invention are not subjected to as great a pressure as hoses 42. Thus, the overall cost of the four hoses 41, 41, 42 and 42 is reduced by virtue of the fact that the two highest pressure hoses 42 are relatively small in diameter and therefore less expensive than if they were required to be the same diameter as hoses 41.

The operation of units 39 and piston and cylinder mechanisms 18 and 19 is controlled by manipulation of a control unit or console 43 which is preferably located on the rig floor adjacent the jack mechanism for manual actuation by an operator, and which is connected to the rest of the hydraulic elements by lines extending downwardly beneath the floor.

Figure 4:
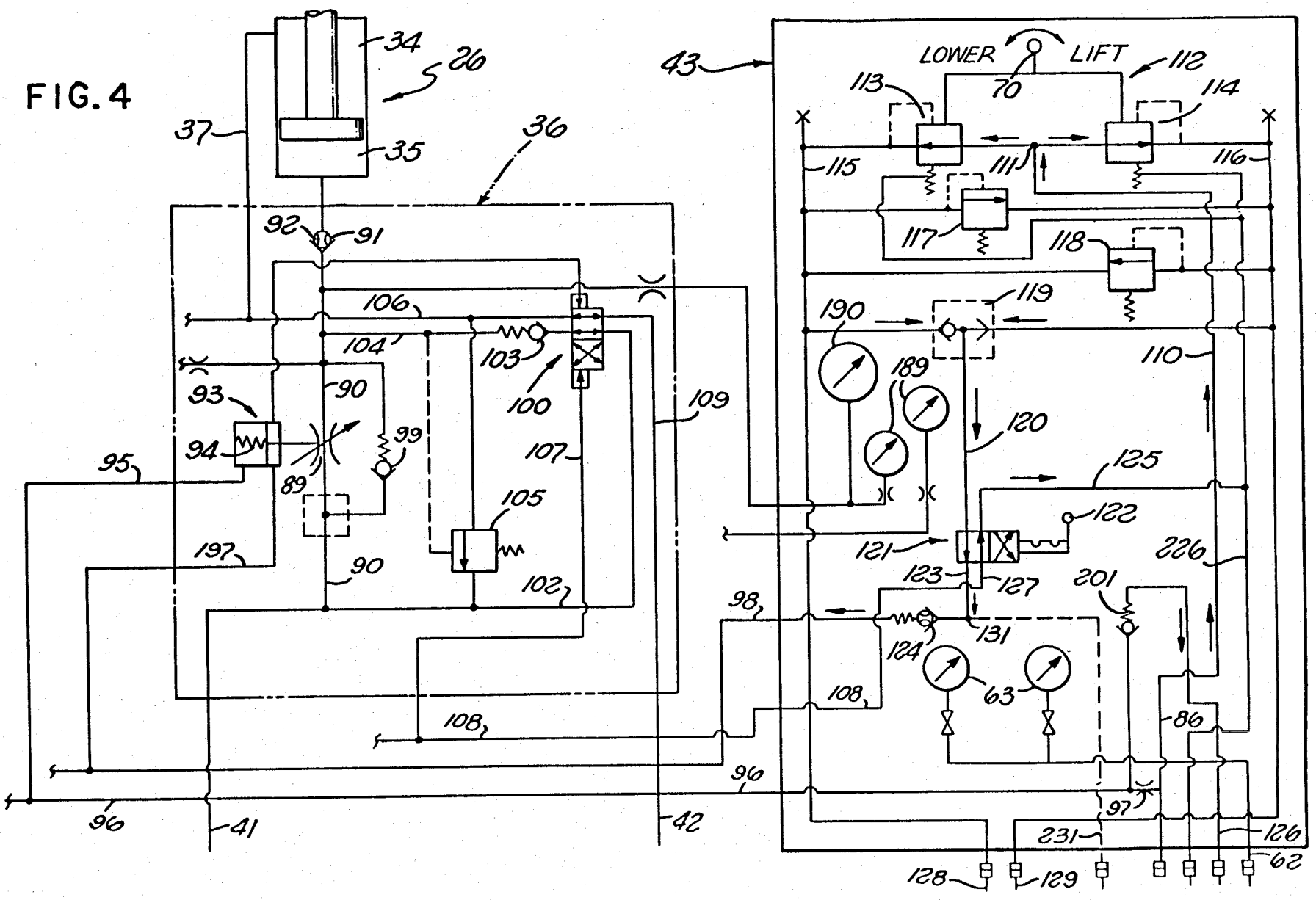
FIGS. 4 and 5 are more detailed hydraulic circuit diagrams of portions of the FIG. 3 circuit.
Figure 5:
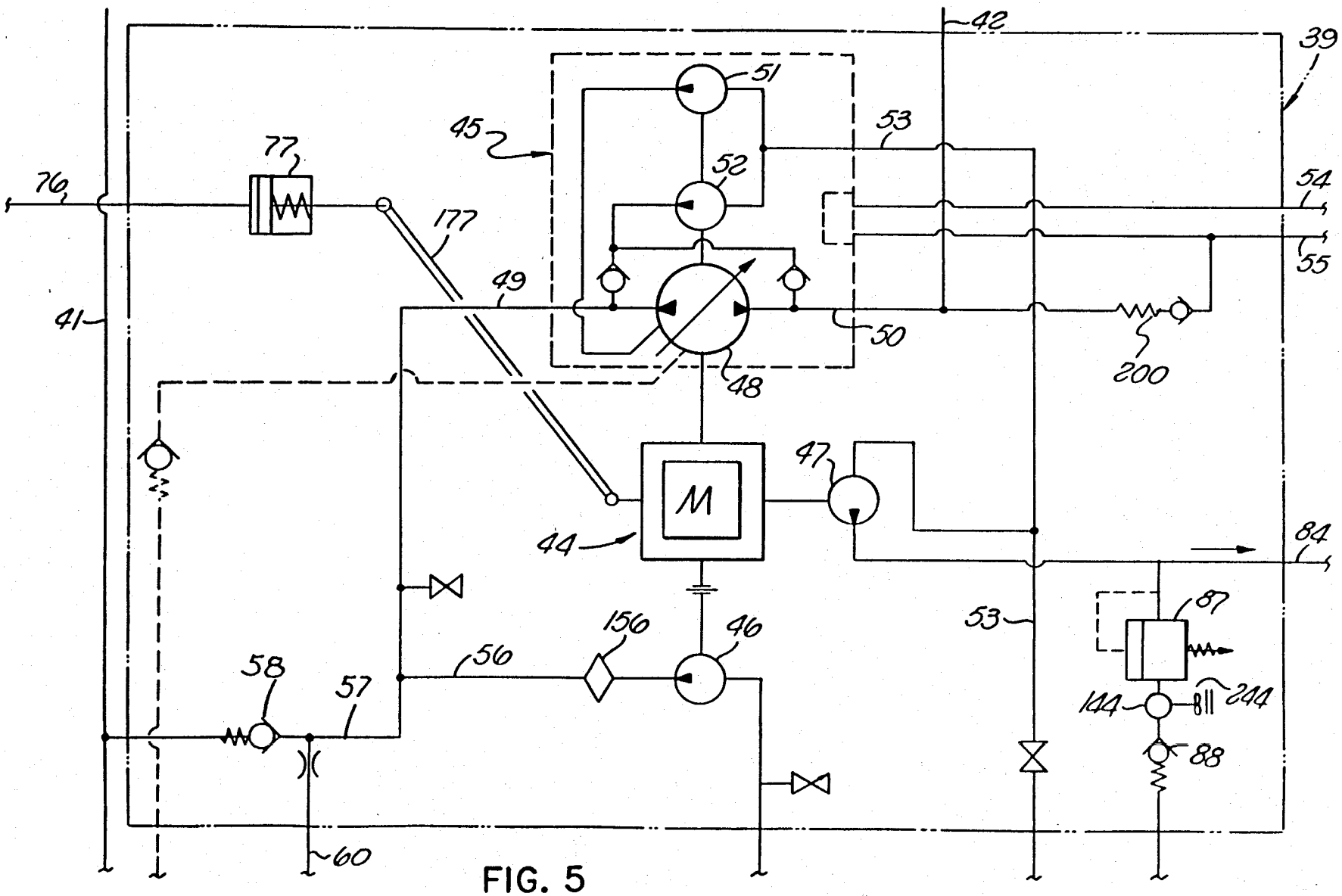

FIGS. 4 and 5 illustrate the units 36 and 39 and some of the other equipment associated with one of the power cylinders. The corresponding units 36 and 39 associated with the other cylinder are not illustrated specifically, but may be considered as identical with the units 36 and 39 of FIGS. 4 and 5. As seen in FIG. 5, each of the fluid pressure sources 39 includes an engine 44 which may be an internal combustion engine and which acts to continuously drive a variable displacement pump assembly 45 and two additiopal pumps 46 and 47. Each of the pumps 46 and 47 is of the positive displacement type and preferably of fixed displacement. The pumping assembly 45 is also a positive displacement pump, but it can be reversed to pump in opposite directions and is controllably adjustable to vary its displacement in each of the directions from zero to a predetermined maximum. Assembly 45 may be of the well known wobble plate type, and include a main pump 48 which in one condition pumps into a line 49 and takes suction from a line 50, and in its reverse condition takes suction from line 49 and discharges into line 50. The assembly 45 may also include two auxillary pumps 51 and 52 as commonly employed in a wobble plate pump assembly, with these auxillary pumps being driven in unison with the primary variable displacement pump 48 by engine 44 and taking suction from reservoir 40 through a line 53, pump 51 being utilized to provide internal servo pressure to pump 48 for actuating it to different positions in response to hydraulic control pressures supplied to variable displacement pump assembly 45 through two control lines 54 and 55, and pump 52 serving as a replenishment pump to at all times assure presence of sufficient fluid at both the inlet and outlet of the main pump 48. Any other appropriate type of reversible variable displacement positive displacement pump may be substituted for the typically illustrated conventional assembly 45.

Line 49 from variable displacement pump 48 is connected to the discharge line 56 from pump 46, so that these two pumps may discharge in parallel through a line 57 and check valve 58 to the large diameter low pressure line 41 leading to the corresponding cylinder. A heat exchanger 156 is connected into line 56 to cool the fluid from pump 46. The pressure in line 57 is communicated through a line 60 to a shuttle valve 61 which is also connected to the corresponding line **60*a* from the other fluid pressure source 39, with the shuttle valve acting to deliver the greater of the pressures in lines 60 and 60*a* through a line 62 to gauges 63 at the console 43. Excessive pressure in lines 41 may discharge to reservoir 40 through a line 59 and one or more relief valves 64. During lowering of the pistons and their load, fluid leaving the lower ends of the cylinders through hoses 41 may be discharged from line 59 to the reservoir through a shut-off valve 65, which may be normally retained by spring force in an open position and be actuable to either a fully closed condition or a partially closed reduced flow condition by delivery of hydraulic pressure signals of two different values through a line 66 to a pressure actuated bellows or piston assembly 67 for operating valve 65**.

Valve 65 and the two variable displacement pumps 45 of power sources 39 are all controlled by hydraulic pressure signals delivered to them from the control unit 43 through a pair of lines 68 and 69 under the control of a control element 70 of unit 43. This element 70 may be a swinging arm or lever which in the neutral full line position of FIG. 4 delivers no hydraulic pressure to either of the lines 68 or 69. Upon swinging movement in a leftward direction as seen in FIG. 4, element 70 applies a progressively increasing pressure to line 68, while swinging movement of element 70 in a rightward directon applies a progressively increasing pressure to line 69. These pressures are applied to the variable displacement pump assemblies 45 through lines 54 and 55 respectively. When no pressure signal is present in either of the lines 54 or 55, the corresponding variable displacement pump is in neutral or off position in which it is not pumping in either direction. A progressive increase in pressure in line 54 causes variable displacement pump 45 to pump fluid in a rightward direction as seen in FIG. 5, with the displacement of the pump and the rate of pumping action increasing progressively in correspondence with the extent to which control element 70 has been swung from its neutral position. Similarly, a progressive increase in pressure in line 55 causes the pump to discharge fluid in a leftward direction as seen in FIG. 5, and with the displacement and rate of discharge increasing progressively in correspondence with the extent to which control element 70 is swung to the right as viewed in FIG. 4.

These same pressure signals from lines 68 and 69 are delivered through a pair of lines 71 and 72 to a shuttle valve 73 whose discharge line 74 therefore receives a pressure signal corresponding to the greater of the pressures in lines 71 and 72. That pressure is delivered through a restriction 75 to a line 76 which communicates with a pressure actuated piston or bellows type operator 77 for actuating a mechanical throttle control 177 of engine 44. Line 76 is similarly connected to a corresponding throttle control of the second pressure fluid source 39. Thus, whenever control element 70 is moved in either direction to cause either upward or downward movement of the power pistons, the resulting pressure in either of the lines 71 and 72 actuates the engine throttle to quickly bring the engines up from idle speed to a predetermined maximum operating speed. This pressure is maintained just sufficient to operate the actuators 77, and excess pressure is exhausted to the reservoir through a check valve 78, line 79 and a spring pressed check valve or relief valve 80 set to maintain the desired pressure, say for example five pounds per square inch.

Lines 72 and 71 are also connected to a second shuttle valve 173, which discharges into line 66 leading to control 67 for valve 65. A relief valve 273 relieves pressure beyond a predetermined value from the line 71 side of shuttle valve 173 and discharges excess fluid to the reservoir. Shut-off valve 65 is normally open, and commences to close upon development of any pressure in lines 72 and 66 resulting from movement of control element 70 in a rightward direction as seen in FIG. 4. That pressure quickly reaches a value high enough to completely close valve 65 during the initial portion of the rightward movement of the control element and retains the valve closed as the control element moves rightwardly through the remainder of its range of travel. When valve 65 is closed, the full output of pumps 48 and 46 is delivered to the lower ends of the power cylinders.

When control element 70 is moved leftwardly, the initial portion of that movement results in development in line 66 of a pressure great enough to partially close valve 65 to an intermediate reduced flow condition determined by the setting of relief valve 273. The pressure in line 66 remains at that valve during further leftward movement of control element 70, and never reaches the full closure attained when element 70 is moved rightwardly, to thus retain valve 65 in its partially closed condition during movement of element 70 through most of its range of travel leftwardly.

Lines 71 and 72 may be connected to line 79 through very restricted chokes 81 and 83, which allow very limited and slow bleeding of excess fluid from lines 71 and 72 to line 79 while maintaining pressures in lines 71 or 72 high enough to actuate valve 65 as discussed when the control element 70 is moved from its neutral position. A less restricted choke 181 between line 66 and shuttle valve 173 prevents excessively abrupt actuation of valve 65 by pressure in line 72.

The pump 47 of each of the pressurized fluid sources 39 takes suction from the reservoir through line 53 and discharges a stream of hydraulic fluid under pressure into a line 84 or 84*a* and to a shuttle valve 85, which then delivers this pressurized fluid through a line 86 to the control console 43 to be used therein for control purposes. A relief valve 87 and a check valve 88 may discharge pressure in line 84 in excess of a predetermined value, say for example 300 p.s.i., through a fluid driven fan motor 144 and a check valve 88 to the reservoir, with motor 144 acting to drive the radiator cooling fan 244 of engine 44 in response to such flow of liquid through the motor.

As seen in FIG. 4, each of the valve or manifold assemblies 36 at the bottoms of the power cylinders includes a throttling control valve 89 which is connected into a line 90 extending between hose 41 and the lower chamber 35 in cylinder 26. Also connected into that line, between valve 89 and the cylinder, is a check valve 91, which allows relatively unrestricted movement of fluid from valve 89 into cylinder chamber 35, and which permits a slower rate of flow in the opposite direction, typically through a passage 92 formed in the seating element of valve 91, with the pressure between valves 89 and 91 of each valve assembly being indicated to an operator on an associated gauge 189. Another pressure responsive gauge 190 may be actuated by the same pressure as one of the gauges 189 but be calibrated in weight units to indicate the total weight of the string of casing which is suspended by the jacking mechanism at a particular time. Valve 89 acts to throttle the flow of fluid through line 90, and for that purpose is adapted by actuation of its movable valve element to open the fluid passage through valve 89 progressively more widely under the control of a fluid powered actuator 93. Valve 89 is normally urged to a closed condition by a spring 94 of actuator 93 and by pressure fluid delivered to actuator 93 through lines 95 and 96 from control unit 43. As seen in FIG. 4, line 96 communicates through a restriction 97 with the previously mentioned line 86 which is pressurized by pump 47 whenever engine 44 is in operation. Valve 89 is opened by pressure fluid delivered to actuator 93 through a line 197 and a connecting line 98 within which pressure progressively increases when control element 70 is moved in either direction from its central neutral position during rapid raising or lowering of the power cylinders. As element 70 causes a progressive increase in pressure in line 98, that pressure quickly exceeds the combined effects of spring 94 of valve actuator 93 (FIG. 4) and the pressure in line 95 and then progressively opens valve element 89 so that during a piston lowering operation fluid can discharge progressively more rapidly from chamber 35 in the bottom of the cylinder to thereby increase and controllably regulate the rate that the pistons and supported casing are allowed to descend. The restricted opening in valve 91 coacts with valve 89 in slowing the rate of downward flow of fluid through line 90, to prevent the pistons and their load from falling too rapidly. A check valve 99 allows fluid to bypass valve 89 in flowing toward cylinder chamber 35 but not in the reverse direction. A spring pressed check valve relieves the pressure in line 96 and the left hand chamber of valve actuator 93 of FIG. 4 to a predetermined regulated value (e.g. 65 p.s.i.) well below the valve opening pressures in line 197 to permit the discussed controlled progressive opening of valve 89. The pressure in line 95 is, however, great enough to maintain valve 89 closed in the event of breakage of spring 94 except when opening pressure is purposely applied to the valve through line 96.

Each valve assembly 36 also includes a reversing valve 100 which in the condition illustrated in FIG. 4 connects hose 42 from the variable displacement pump 45 to line 37 leading to the upper chamber 34 in the corresponding power cylinder 26, above the contained piston 31. Thus, when variable displacement pump 45 is set to pump in a leftward direction as seen in FIG. 5, fluid is permitted to flow from upper cylinder chamber 34 through line 37 and valve 100 to the suction side of the variable displacement pump, with the result that this pump then acts to meter the flow from the upper cylinder chamber 34 and thereby controls the rate of upward movement of the pistons in accordance with the displacement to which pump 45 has been set. In the FIG. 4 condition of valve 100, that valve also acts to connect a line 102 with a check valve 103 connected into a line 104 leading to the previously mentioned line 90 above valve 89. A sequence valve 105 is set to unload pressure from line 106 into line 102 upon attainment in line 104 of a pressure beyond a predetermined value, say for example 600 p.s.i. The reversing valve 100 is normally retained in the position illustrated in FIG. 4 by hydraulic pressure delivered through line 197, and is actuable from that condition to a reversed condition by fluid pressure in line 107 connecting with a line 108 from the control unit 43. When valve 100 is fluid actuated to that changed reversed condition, line 109 is connected by valve 100 to line 104 to deliver pumped fluid from the right side of variable displacement pump 45 into the lower chamber 35 of the power cylinder, and line 106 is connected to line 102 to allow discharge through valve 100 of fluid from the upper cylinder chamber to hose 41 and the reservoir.

Describing now in greater detail the control unit or console 43 (FIG. 4), the control pressure developed by the two engine driven pumps 47 is delivered from line 86 through a line 110 to a central point 111 of a reversing throttling valve 112 actuated by the previously discussed control element 70. Valve 112 is diagrammatically represented as including two throttling valve units 113 and 114 controlling the flow of fluid from point 111 into two lines 115 and 116 respectively. In the central neutral position of control element 70, both of the valves 113 and 114 are closed. Leftward movement of element 70 from that position progressively opens valve 113 to progressively increase the pressure in line 115 from 0 to a predetermined maximum while maintaining valve 114 closed. Similarly, rightward movement of element 70 from the neutral position progressively opens valve 114 to progressively increase the pressure in line 116 while keeping valve 113 closed. Relief valves 117 and 118 unload excessive pressure from either of the lines 115 or 116 when the pressure in one line exceeds that in the other line more than a predetermined amount, say for example 340 p.s.i.g. Excess fluid from valves 113 and 114 is returned to the reservoir through a drain line 226.

Both of the lines 115 and 116 are connected to a shuttle valve 119, with a common outlet 120 to which pressure developed in either of the lines 115 or 116 is communicated. A reversing valve 121 is actuable manually by the operator through movement of a control element 122 of control console 43, and is normally retained by detents or otherwise in the condition represented in FIG. 4. In that condition, valve 121 delivers the regulated hydraulic pressure in line 120 to a line 123 and then through a check valve 124 to the previously mentioned line 98 leading to lines 197 of the two valve assemblies 36, to thereby open throttling valves 89 in correspondence with the pressure developed within line 115 or 116 as a result of movement of element 70 in either direction. At the same time, valve 121 connects line 108 and the control portions of valves 100 with a line 125 which communicates with drain line 226 leading back to the reservoir, to whereby assure that valves 100 will remain in their illustrated condition. When control arm 70 is returned to its neutral position, the pressure fluid which had theretofore held valves 89 open is allowed to flow back through lines 197, 98, 123 and 120 to lines 115 and 116 with resultant closure of valves 89, to prevent further lowering of the pistons and their load. Check valve 124 is of a type allowing some restricted reverse flow through the valve (rightwardly in FIG. 4) in the seated condition of the valve, to permit depressurization of actuators 93 of valves 89, but at a gradual rate avoiding overly abrupt termination of the piston movement.

When valve 121 is reversed by manual actuation of element 122 leftwardly in FIG. 4, and control element 70 is moved rightwardly from its neutral position, valve 121 acts to deliver the manually regulated pressure in line 120 through a line 127 to the lines 108 and 107 and reversing valves 100, and at the same time valve 121 discharges pressure from line 98 and the actuators 93 of valves 89 through line 125 and a drain line 226 to the reservoir. Thus, actuation of valve 121 to this reverse condition causes valves 89 to be retained in closed condition by their springs 94, and actuates valves 100 to their reversed condition in which the variable displacement pumps 45 deliver pressure fluid through hoses 42, lines 109, valves 100, and lines 104 to the underside of the power pistons to actuate them upwardly at potentially high force level dependent upon the casing string load.

The regulated pressures developed in lines 115 and 116 are also communicated through a pair of hoses 128 and 129 to lines 68 and 69 whose pressures control reversal and regulation of the variable displacement pumps and operation of valve 65. A reversing valve 130 is connected into lines 68 and 69 and responds to a reduction in pressure at the point 131 beneath valve 121, resulting from leftward actuation of valve 121 as seen in FIG. 4, to reverse the connections at valve 130. More specifically when valve 121 is in its FIG. 4 position, the pressure at point 131 is communicated through a line 231 to valve 136 and maintains that valve in the illustrated position in which line 128 is connected to line 68 and line 129 is connected to line 69. When the pressure drops at point 131 upon reversal of valve 121, this causes corresponding reversal of valve 130, resulting in reversal of the direction in which pumps 48 flow.

Figure 6:
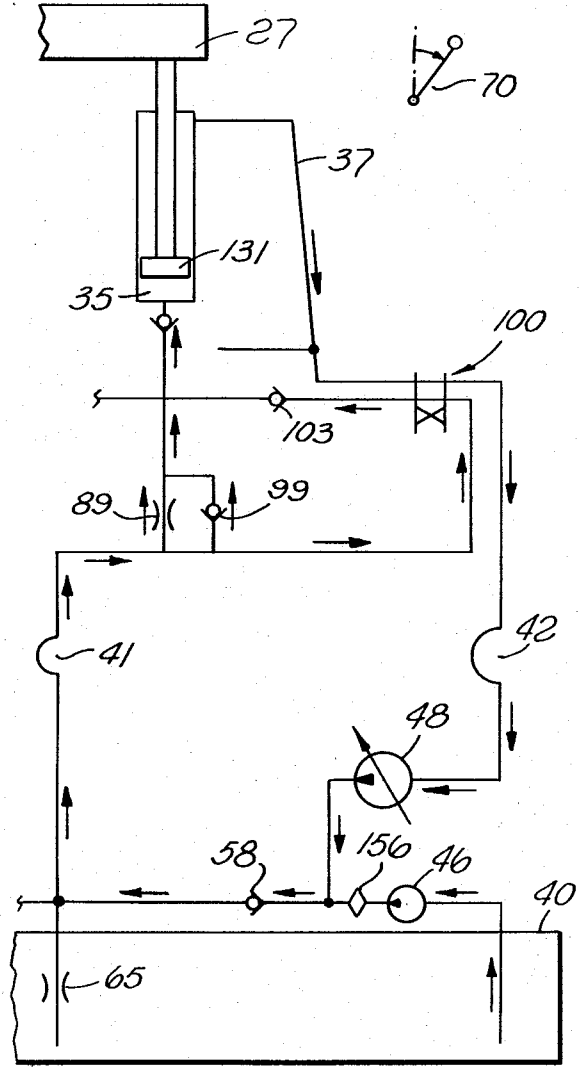

FIG. 6 illustrates diagrammatically the condition of the apparatus during rapid elevation of the pistons 31 and supported beam 27 and gripping unit 30. During such lifting of the pistons, it may be assumed that gripping unit 30 is in released condition and is not acting to support casing 17, while gripping unit 29 is in engagement with and supporting the casing. The force required for such lifting of the pistons and connected parts is thus not as great as when the casing is supported by the pistons. To cause such rapid lifting of the pistons and connected parts, the control element 70 is actuated to the right, as illustrated in FIG. 4, communicating the pressure developed by pumps 47 to line 116, hose 129 and line 69, to deliver a control pressure through lines 55 to the variable displacement pumps 48 in a manner causing them to pump leftwardly as viewed in FIG. 5. At the same time, the control pressure from line 116 is communicated through shuttle valve 119, lines 120, 123, 98 and 197 to the actuators 93 causing valves 89 to open. The rate at which variable displacement pumps 48 are driven and the extent to which throttling valves 89 are opened correspond to the distance through which control element 70 is moved to the right from its neutral position. The pressure in lines 55 is also communicated through line 72 to actuator 67 for normally open valve 65 causing that valve to close, and is communicated through shuttle valve 73 and its discharge line 74 to engine throttle controls 177 bringing the engines both rapidly up to their predetermined maximum operating speed. In this fast lift condition, actuating pressure is not delivered to reversing valves 100, and consequently they remain in their lower position as illustrated in FIG. 4. With the control 70 in its rightwardly displaced fast lift condition, the hydraulic fluid flow pattern is as illustrated in FIG. 6. In particular, each variable displacement pump 48 pumps leftwardly in parallel with pump 46, and past check valve 58, and with shut-off valve 65 closed the combined flow is directed through the large diameter low pressure hose 41 toward the cylinder, and is permitted to pass through all of the valves 89, 99 and 100 to chamber 35 beneath the piston causing upward movement thereof. The return flow from the upper end of the cylinder is delivered through valve 100 and the high pressure small diameter hose 42 to the suction side of variable displacement pump 48, which as previously indicated acts to limit that return flow and to meter it in a manner effectively controlling and regulating the rate of upward movement of the pistons. The same flow pattern of course occurs in connection with each of the cylinders, and by virtue of the parallel interconnection of the two cylinders their pressures are balanced. The bridge 27 maintains the pistons together in their upward movement.

Figure 7:
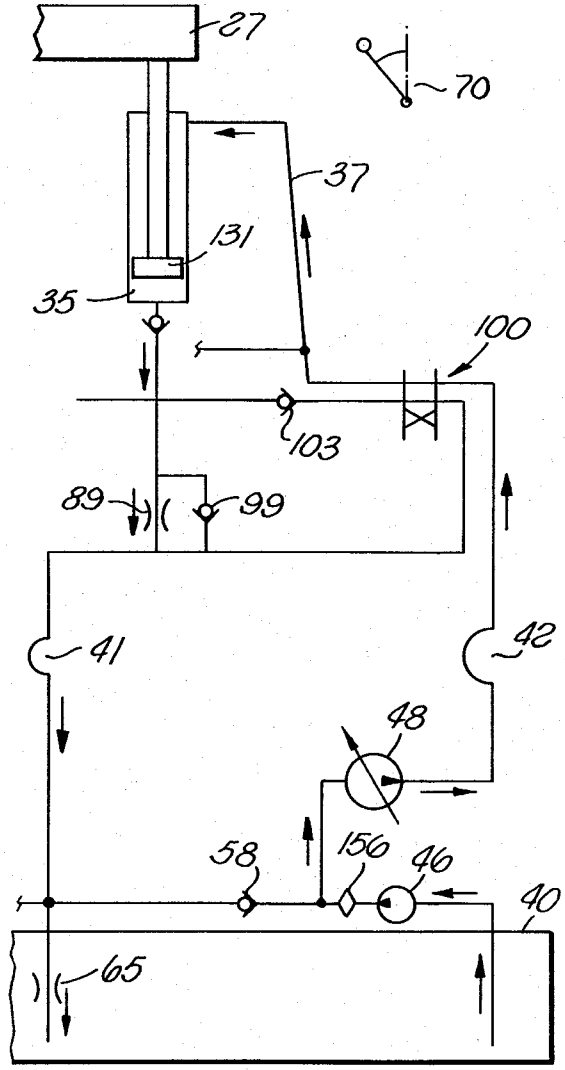

During lowering of the pistons the control element 70 is in the leftwardly actuated position illustrated in FIG. 7, and the valves 89 and 100 remain in the same condition as in FIG. 6. The variable displacement pump 48, however, is reversed to pump in the righthand direction and valve 65 is in its previously mentioned partially open intermediate setting, both by virtue of the fact that leftward movement of control element 70 causes development of a pressure signal in line 115 of FIG. 4 rather than line 116, with that pressure in line 115 being communicated through hose 128 and line 68 to lines 54 and 71, rather than lines 55 and 72. The flow paths are then as illustrated in FIG. 7, with the variable displacemeht pumps 48 delivering pressurized fluid through hoses 42 and valves 100 to the upper ends of the cylinders, and with fiuid discharging from the lower ends of the cylinders through throttling valves 89 and large diameter hoses 41 and valve 65 to the reservoir. The rate of downward movement is regulated by the amount of restriction afforded by throttling valve 89, which restriction varies in correspondence with the extent to which control element 70 is swung leftwardly from its neutral position. The rate of descent is thus very accurately regulatable by the operator. In this FIG. 7 condition, pump 46 discharges to the suction side of variable displacement pump 48, to assure delivery of an adequate supply of fluid thereto and to assure effective discharge of fluid rightwardly by pump 48.

Figure 8:
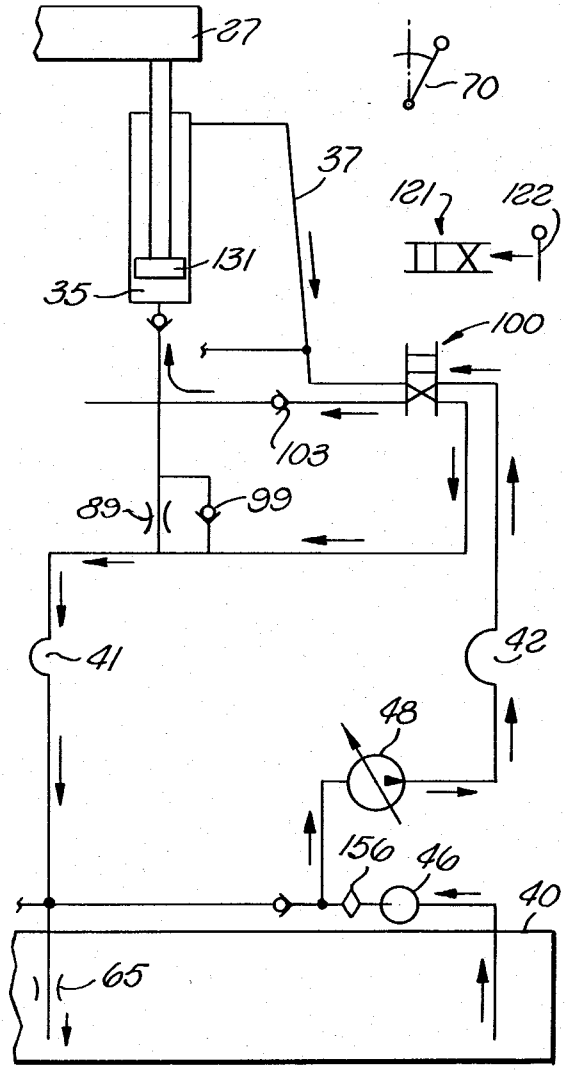
FIGS. 6, 7 and 8 illustrate diagrammatically the primary fluid flow paths in three different conditions of the apparatus.

When it is desired to shift the weight of the casing string from the lower gripping unit 29 to the upper gripping unit 30 and the pistons, it is desirable to first actuate the slips of gripping unit 30 to their gripping condition and then very slowly raise gripping unit 30 to assist in releasing the slips of the lower unit 29. This slow lifting of gripping unit 30 requires greater force than does the fast lift represented in FIG. 6, and consequently for this purpose the apparatus is actuated to the FIG. 8 slow lift high force condition. This condition is attained by actuating control element 122 (FIGS. 4 and 8) leftwardly to reverse valve 121, and by swinging element 70 to the right. Reversal of valve 121 causes delivery of the pressure from line 120 of FIG. 4 through valve 121 to line 127 rather than line 123, with that pressure then being communicated through lines 108 and 107 to the actuators of valves 100, reversing those valves and connecting the right sides of variable displacement pumps 48 to the undersides of the power pistons. The decrease in pressure at point 131 in FIG. 4 simultaneously acts through line 231 to cause actuation of valve 130 to reverse the connections to lines 68 and 69 as discussed, and thus cause pumps 48 to pump rightwardly as seen in FIG. 8, with valve 65 being in the same partially open condition as in FIG. 7. Hydraulic fluid is delivered by pumps 46 from the reservoir to the left suction side of variable displacement pumps 48, which deliver the fluid through high pressure hoses 42 and valves 100 to the undersides of the corresponding power pistons, with the return flow from the upper ends of the cylinders being delivered through valves 100, lines 102, hoses 41, and valve 65, and/or the connected relief valves 64, to the reservoir.

In the central neutral position of control element 70, the absence of pressure in either of the control lines 115 or 116 causes return of engines 44 to idle condition in which none of the pumps 46 and 48 are driven, and no fluid is pumped to either end of the power cylinders 18 or 19, thus maintaining pistons 28 in the positions to which they had previously been set. The drives between engines 44 and pumps 46 and 48 are automatically broken in this idle condition in any appropriate manner, as by automatic speed responsive clutches in the engines. The absence of pressure in lines 115 and 116 and both of the lines 54 and 55 also causes the variable displacement pumps 48 to be in their neutral non-pumping condition, and relieves all pressure in actuator 67 of valve 65 with resultant actuation of valve 65 to its fully open condition.

If the operator inadvertently places the equipment in the fast lift condition of FIG. 6 when the weight of the entire string is suspended by the jacking pistons and the load is thus excessive, the variable displacment pumps 48 are automatically shifted to their neutral zero output conditions. This result is achieved by provision in each unit 39 (FIG. 5) of a spring pressed check valve 200 which functions as a relief valve and acts upon attainment of a predetermined pressure differential (typically 135 p.s.i.) between line 55 and line 42 to relieve the control pressure from line 54 and cause return of pump 45 to its nonpumping condition. During normal operation of the equipment, the pressure differential between lines 55 and 42 is not great enough to open relief valve 200, but under the discussed conditions when the equipment is set for fast lift the under heavy load the inability of the pumps to raise the jacking pistons under that load results in delivery of insufficient liquid from the upper ends of cylinders 26 through lines 42 to the suction sides of pumps 48 to maintain a flow of liquid through these pumps. The consequent reduction in pressure in suction lines 50 to pumps 48 applies to valves 200 the differential pressure needed to open these valves and return the pumps 48 to zero flow condition as discussed.

In each of the conditions of FIGS. 6, 7 and 8, the rate of vertical movement of the pistons and connected parts is accurately controllable from a very slow speed to maximum speed for that particular condition, and the movement can be halted at any position of the pistons.

While a certain specific embodiment of the present invention has been disclosed as typical, the invention is of course not limited to this particular form, but rather is applicable broadly to all such variations as fall within the scope of the appended claims.

I claim:

1. Jacking mechanism comprising:

two vertically extending cylinders to be received at different sides of a well pipe;

pistons reciprocable vertically within said cylinders by pressure fluid and having upwardly projecting rods;

a first gripping unit adapted to releasably engage and support a well pipe and retained against vertical movement relative to said cylinders;

a second gripping unit adapted to releasably engage and support the pipe and movable vertically relative to said first unit with said rods to jack the pipe vertically;

said pistons having downwardly facing areas exposed to said fluid which are greater than the effective upwardly facing areas thereof;

two power driven reversible variable displacement pumps operable to pump fluid with a positive displacement action in opposite directions and adjustable to vary the displacement in each of said directions;

two additional positive displacement pumps;

fluid reservoir means;

a system of conduits connected to said cylinders and said four pumps and said reservoir and including a variable restriction valve at the location of each cylinder and a reversing valve at the location of each cylinder, and including a large diameter low pressure hose connected to each cylinder and a small diameter high pressure hose connected to each cylinder; and control means including a first control element movable in opposite directions from a central position and means operable by movement of said element in one of said directions to cause each of said variable displacement pumps to pump fluid in parallel with an associated one of said additional pumps through the associated large diameter hose to the lower portion of an associated one of said cylinders, with fluid returning from the upper end of the cylinder through the associated small diameter hose to the suction side of the variable displacement pump, and by movement of said element in the opposite direction to cause each variable displacement pump not operating in parallel with said associated additional pump to discharge fluid in a reverse direction through the associated one of said small diameter hoses to the upper end of the associated cylinder, with fluid discharging from the lower end of the cylinder through the associated larger diameter hose to said reservoir means, with the displacement of said variable displacement pump increasing progressively in accordance with the extent of movement of said first control element from said central position, and with said variable restriction valve offering restriction to the flow of fluid from the lower ends of said cylinders to said large diameter hoses, and said first control element acting to progressively open said variable restriction valves in correspondence with the extent of movement of said first control element from said central position;

said control means including a second control element operable to reverse connections to said cylinders and cause said variable displacement pumps not operating in parallel with said additional pumps, to discharge in said reverse direction to deliver fluid to the lower ends of said cylinders beneath said pistons, with fluid discharging from the upper ends of the cylinders to said reservoir means.

2. Jacking mechanism comprising:

vertically extending cylinder means;

piston means reciprocable vertically within said cylinder means by pressure fluid and having upwardly projecting rod means;

a first unit adapted to releasably engage and support a pipe and retained against vertical movement with said rod means;

a second unit adapted to releasably engage and support the pipe and movable vertically relative to said first unit with said rod means to jack the pipe vertically;

said piston means having a downwardly facing area exposed to said fluid which is greater than the effective upwardly facing area thereof;

power driven reversible variable displacement pump means operable to pump fluid with a positive displacement action in opposite directions and adjustable to vary the displacement in each of said directions;

additional pump means;

a system of conduits connected to said cylinder means and said two pump means; and control means for said variable displacement pump means and said conduit system actuable between a first condition in which said variable displacement pump means pump fluid in a first direction therethrough and, in parallel with said additional pump means, deliver a combined flow of fluid into said cylinder means at the underside of said piston means, while the suction side of said variable displacement pump means receives and meters a smaller flow of fluid from above the piston means, and a second condition in which said variable displacement pump means, not operating in parallel with said additional pump means, pump fluid in a reverse direction and into the cylinder means above said piston means;

said conduit system, in said second condition of said control means, delivering fluid from the discharge side of said additional pump means to said variable displacement pump means to be pumped thereby in said reverse direction for delivery to the cylinder means above said piston means.

3. Jacking mechanism as recited in claim 2, in which said conduit system includes variable restriction throttling valve means adjustably restricting the discharge of fluid from beneath said piston means in said second condition of the control means.

4. Jacking mechanism as recited in claim 2, including reservoir means for containing a supply of fluid and from which said additional pump means take suction, said conduit system including a line which delivers fluid from said two pump means in parallel into said cylinder means beneath said piston means in said first condition of the control means and which returns fluid from beneath said piston means to said reservoir in said second condition of the control means, and a valve operable to automatically close off communication between said line and said reservoir in said first condition of said control means.

5. Jacking mechanism as recited in claim 2, in which said conduit system includes variable restriction throttling valve means adjustably restricting the discharge of fluid from beneath said piston means in said second condition of the control means, said control means being operable in said second condition to progressively increase the displacement of said variable displacement pump means and open said throttling valve means progressively more widely.

6. Jacking mechanism as recited in claim 2, in which said conduit system includes variable restriction throttling valve means adjustably restricting the discharge of fluid from beneath said piston means in said second condition of the control means, said control means including a control element operable in a predetermined central position to maintain said variable displacement pump means in a zero displacement condition and operable by movement in opposite directions from said central position to cause said variable displacement pump means to pump fluid in opposite directions respectively and to progressively increase the displacement of the pump means in each of said directions, said control means including means for progressively opening said throttling valve means in response to movement of said element in a direction causing said variable displacement pump means to pump fluid in said reverse direction.

7. Jacking mechanism comprising:

vertically extending cylinder means;

piston means reciprocable vertically within said cylinder means by pressure fluid and having upwardly projecting rod means;

a first unit adapted to releasably engage and support a pipe and retained against vertical movement with said rod means;

a second unit adapted to releasably engage and support the pipe and movable vertically relative to said first unit with said rod means to jack the pipe vertically;

said piston means having a downwardly facing area exposed to said fluid which is greater than the effective upwardly facing area thereof;

power driven reversible variable displacement pump means operable to pump fluid with a positive displacement action in opposite directions and adjustable to vary the displacement in each of said directions;

additional pump means;

a system of conduits connected to said cylinder means and said two pump means; and control means for said variable displacement pump means and said conduit system actuable between a first condition in which said variable displacement pump means pump fluid in a first direction therethrough and, in parallel with said additional pump means, deliver a combined flow of fluid into said cylinder means at the underside of said piston means, while the suction side of said variable displacement pump means receives and meters a smaller flow of fluid from above the piston means, a second condition in which said variable displacement pump means, not operating in parallel with said additional pump means, pump fluid in a reverse direction and into the cylinder means above said piston means, and a third condition in which said variable displacement pump means pump fluid in said reverse direction and into the cylinder means beneath said piston means.

8. Jacking mechanism as recited in claim 7, in which said additional pump means, in said third condition of said control means, discharge fluid to the suction side of said variable displacement pump means.

9. Jacking mechanism as recited in claim 8, including variable restriction throttling valve means adjustably restricting the discharge of fluid from beneath said piston means in said second condition of the control means.

10. Jacking mechanism as recited in claim 7, in which said conduit system includes variable restriction throttling valve means adjustably restricting the discharge of fluid from beneath said piston means in said second condition of the control means, said control means being operable in said second condition to progressively increase the displacement of said variable displacement pump means and open said throttling valve means progressively more widely.

11. Jacking mechanism as recited in claim 7, in which said conduit system includes variable restriction throttling valve means adjustably restricting the discharge of fluid from beneath said piston means in said second condition of the control means, said control means including a control element operable in a predetermined central position to maintain said variable displacement pump means in a zero displacement condition and operable by movement in opposite directions from said central position to cause said variable displacement pump means to pump fluid in opposite directions respectively and to progressively increase the displacement of the pump means in each of said directions, said control means including means for progressively opening said throttling valve means in response to movement of said element in a direction causing said variable displacement pump means to pump fluid in said reverse direction.

12. Jacking mechanism comprising:

vertically extending cylinder means;

piston means reciprocable vertically within said cylinder means by pressure fluid and having upwardly projecting rod means;

a first unit adapted to releasably engage and support a pipe and retained against vertical movement with said rod means;

a second unit adapted to releasably engage and support the pipe and movable vertically relative to said first unit with said rod means to jack the pipe vertically;

said piston means having a downwardly facing area exposed to said fluid which is greater than the effective upwardly facing area thereof;

power driven reversible variable displacement pump means operable to pump fluid with a positive displacement action in opposite directions and adjustable to vary the displacement in each of said directions;

additional pump means;

a system of conduits connected to said cylinder means and said two pump means;

control means for said variable displacement pump means and said conduit system actuable between a first condition in which said variable displacement pump means pump fluid in a first direction therethrough and, in parallel with said additional pump means, deliver a combined flow of fluid into said cylinder means at the underside of said piston means, while the suction side of said variable displacement pump means receives and meters a smaller flow of fluid from above the piston means, and a second condition in which said variable displacement pump means, not operating in parallel with said additional pump means, pump fluid in a reverse direction and into the cylinder means above said piston means; and an engine driving said two pump means;

said engine and both pump means being positioned at a location spaced from said cylinder means;

said conduit system including a first flexible hose extending from said two pump means to said cylinder means for delivering fluid at a first pressure from said two pump means in parallel to said cylinder means beneath said piston means in said first condition of the control means and returning said fluid from the cylinder means in said second condition;

said conduit system including a second flexible hose smaller in diameter than said first hose but adapted to withstand a higher pressure than the first hose and through which fluid at said higher pressure flows from the variable displacement pump means to said cylinder means in said second condition of the control means;

said second hose acting to return fluid from above said piston means to said variable displacement pump means in said first condition of the control means.

13. Jacking mechanism as recited in claim 12, in which said conduit system includes a variable restriction throttling valve mounted at essentially the location of said cylinder means and adjustably restricting the discharge of fluid from beneath the piston means to said first hose in said second condition of the control means.

14. Jacking mechanism as recited in claim 12, in which said conduit system includes variable restriction throttling valve means adjustably restricting the discharge of fluid from beneath said piston means in said second condition of the control means, said control means being operable in said second condition to progressively increase the displacement of said variable displacement pump means and open said throttling valve means progressively more widely.

15. Jacking mechanism as recited in claim 12, in which said conduit system includes variable restriction throttling valve means adjustably restricting the discharge of fluid from beneath said piston means in said second condition of the control means, said control means including a control element operable in a predetermined central position to maintain said variable displacement pump means in a zero displacement condition and operable by movement in opposite directions from said central position to cause said variable displacement pump means to pump fluid in opposite directions respectively and to progressively increase the displacement of the pump means in each of said directions, said control means including means for progressively opening said throttling valve means in response to movement of said element in a direction causing said variable displacement pump means to pump fluid in said reverse direction.

16. Jacking mechanism comprising:

vertically extending cylinder means;

piston means reciprocable vertically within said cylinder means by pressure fluid and having upwardly projecting rod means;

a first unit adapted to releasably engage and support a pipe and retained against vertical movement with said rod means;

a second unit adapted to releasably engage and support the pipe and movable vertically relative to said first unit with said rod means to jack the pipe vertically;

said piston means having a downwardly facing area exposed to said fluid which is greater than the effective upwardly facing area thereof;

power driven reversible variable displacement pump means operable to pump fluid with a positive displacment action in opposite directions and adjustable to vary the displacement in each of said directions;

additional pump means;

a system of conduits connected to said cylinder means and said two pump means; and control means for said variable displacement pump means and said conduit system actuable between a first condition in which said variable displacement pump means pump fluid in a first direction therethrough and, in parallel with said additional pump means, deliver a combined flow of fluid into said cylinder means at the underside of said piston means, while the suction side of said variable displacement pump means receives and meters a smaller flow of fluid from above the piston means, and a second condition in which said variable displacement pump means, not operating in parallel with said additional pump means, pump fluid in a reverse direction and into the cylinder means above said piston means;

said control means including a first control element movable in opposite directions from a central position and acting by such movement to actuate said variable displacement pump means to pump in opposite directions at rates progressively increasing in accordance with the extent of movement of said control element from said central position;

said conduit system including variable restriction throttling valve means adjustably restricting the discharge of fluid from beneath said piston means and progressively opened by movement of said first control element from said central position in said second condition of the control means;

said control means including a second control element operable to actuate the control means to a third condition in which said variable displacement pump means pump fluid in said reverse direction and to the cylinder at a location beneath said piston means;

said conduit system including a reversing valve actuable by said second control element to reverse connections to said cylinder means.

17. Jacking mechanism comprising:

vertically extending cylinder means;

piston means reciprocable vertically within said cylinder means by pressure fluid and having upwardly projecting rod means;

a first unit adapted to releasably engage and support a pipe and retained against vertical movement with said rod means;

a second unit adapted to releasably engage and support the pipe and movable vertically relative to said first unit with said rod means to jack the pipe vertically;

said piston means having a downwardly facing area exposed to said fluid which is greater than the effective upwardly facing area thereof;

power driven reversible variable displacement pump means operable to pump fluid with a positive displacement action in opposite directions and adjustable to vary the displacement in each of said directions;

additional pump means;

a system of conduits connected to said cylinder means and said two pump means; and control means for said variable displacement pump means and said conduit system actuable between a first condition in which said variable displacement pump means pump fluid in a first direction therethrough and, in parallel with said additional pump means, deliver a combined flow of fluid into said cylinder means at the underside of said piston means, while the suction side of said variable displacement pump means receives and meters a smaller flow of fluid from above the piston means, and a second condition in which said variable displacement pump means, not operating in parallel with said additional pump means, pump fluid in a reverse direction and into the cylinder means at the underside of said piston means.

* * * * *